US008434453B2

(12) United States Patent
Okoshi et al.

(10) Patent No.: US 8,434,453 B2
(45) Date of Patent: May 7, 2013

(54) ELECTRONIC THROTTLE CONTROL SYSTEM AND METHOD

(75) Inventors: Satoru Okoshi, Saitama (JP); Kenichi Machida, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 463 days.

(21) Appl. No.: 12/854,450

(22) Filed: Aug. 11, 2010

(65) Prior Publication Data

US 2011/0048373 A1 Mar. 3, 2011

(30) Foreign Application Priority Data

Aug. 28, 2009 (JP) ..... 2009-198172

(51) Int. Cl.
*F02D 11/10* (2006.01)
*F02D 11/04* (2006.01)

(52) U.S. Cl.
USPC ..... 123/399; 123/361

(58) Field of Classification Search ..... 123/399, 123/337, 361, 396, 400, 403; 251/173, 174
See application file for complete search history.

(56) References Cited

U.S. PATENT DOCUMENTS

2003/0196640 A1* 10/2003 Saito et al. ..... 123/399
2005/0178359 A1* 8/2005 Wayama et al. ..... 123/399

FOREIGN PATENT DOCUMENTS

JP 2003214232 A 7/2003
JP 2008088925 A 4/2008

* cited by examiner

*Primary Examiner* — Mahmoud Gimie
(74) *Attorney, Agent, or Firm* — Squire Sanders (US) LLP

(57) ABSTRACT

An electronic throttle control system and method are provided. The system includes a throttle valve, a motor configured to drive the throttle valve, and a throttle position sensor configured to detect an angle of the throttle valve. The system further includes an engine rotating speed detector, and a controller. The controller is configured to drive the motor to control the angle of the throttle valve. The controller is configured to initially set a lower limit value of the angle to an angle which is greater than a full closure angle of the throttle valve by a predetermined amount. The controller is further configured to, when a rise in an engine rotating speed is detected, re-set the lower limit value to reduce it by a predetermined amount to control the engine rotating speed to within a predetermined value from the preset idle speed.

18 Claims, 4 Drawing Sheets

ELECTRONIC THROTTLE CONTROL SYSTEM AND METHOD

BACKGROUND

1. Field

Embodiments of the invention relate to an electronic throttle control system and more particularly to an electronic throttle control system for controlling the angle (position) of a throttle valve by motor drive.

2. Description of the Related Art

In motorcycles and passenger cars, an electronic throttle control system is used that is based on an application of a throttle-by-wire (TBW) control, whereby an operating amount of an accelerator (e.g., grip or pedal) is detected. An optimum angle of a throttle valve is calculated based on the detected accelerator angle and signals from various sensors. A motor is driven based on the calculated target angle to open or close the throttle valve.

Japanese Patent Publication No. 2008-088925 ("JP 2008-088925") discloses an electronic throttle control system in which a lower limit value, greater than a full closure angle (i.e., full closure position) of a throttle valve by a predetermined angle, is set. In this control system, the lower limit value is updated until an opener lever connected to a throttle shaft for turning the throttle valve abuts a full closing stopper. The angle at the moment of the abutment is set as the lower limit value to reduce an idle speed.

In the control system disclosed in JP 2008-088925, it is necessary to abut the opener lever against the full closing stopper to maintain the idle speed at an appropriate level, and therefore, a heavy load is exerted on a reduction gear for driving the throttle valve. On the other hand, to control the throttle angle without using such a stopper, it is necessary to perform a control using a limit value, such that the throttle valve will not interfere with an intake passage under presumed operating conditions. However, in an engine required to exhibit a high output relative to engine displacement, the diameter of the intake passage is set at a high value (i.e., overbore), and dispersions of devices and sensors and overshoots of control are generated. Accordingly, it has been difficult to set a limit value which enables an appropriate setting of an idle speed.

SUMMARY

Embodiments of the invention provide an electronic throttle control system which enables appropriate control of an idle speed, even in a configuration that uses a lower limit value for setting a lower limit angle to avoid interference of a throttle valve with an intake passage.

An embodiment of the invention provides an electronic throttle control system. The electronic throttle control system includes a throttle valve, a motor configured to drive the throttle valve, and a throttle position sensor configured to detect an angle of the throttle valve. The system further includes an engine rotating speed detector, and a controller. The controller is configured to drive the motor to control the angle of the throttle valve. The controller is configured to initially set a lower limit value of the angle to an angle which is greater than a full closure angle of the throttle valve by a predetermined amount. The controller is further configured to, when a rise in an engine rotating speed by not less than a predetermined value from a preset idle speed is detected during idling in which the angle of the throttle valve is controlled to the lower limit value, re-set the lower limit value to reduce the lower limit value by a predetermined amount to control the engine rotating speed to within a predetermined value from the preset idle speed. Further, the controller is configured to return the lower limit value to an original lower limit value in other operating conditions than the idling.

In accordance with another embodiment of the invention, there is provided an electronic throttle control system. The electronic throttle control system includes throttle means for controlling engine air intake, driving means for driving the throttle means, and throttle position sensing means for detecting an angle of the throttle means. The system further includes engine rotating speed detecting means for detecting a rotating speed of an engine, and controlling means. The controlling means is for driving the driving means to control the angle of the throttle means. The controlling means is for initially setting a lower limit value of the angle to an angle which is greater than a full closure angle of the throttle means by a predetermined amount. The controlling means is further for, when the rise in an engine rotating speed by not less than a predetermined value from a preset idle speed is detected during idling in which the angle of the throttle means is controlled to the lower limit value, re-setting the lower limit value to reduce the lower limit value by a predetermined amount to control the engine rotating speed to within a predetermined value from the preset idle speed. The controlling means is further for returning the lower limit value to an original lower limit value in other operating conditions than the idling.

In accordance with another embodiment of the invention, there is provided a method for controlling a throttle valve in an electronic throttle control system. The method includes driving, using a controller, a motor to control an angle of the throttle valve by initially setting a lower limit value of the angle to an angle which is greater than a full closure angle of the throttle valve by a predetermined amount. The method further includes, when a rise in an engine rotating speed by not less than a predetermined value from a preset idle speed is detected, during idling in which the angle of the throttle valve, is controlled to the lower limit value, re-setting, using the controller, the lower limit value to reduce the lower limit value by a predetermined amount to control the engine rotating speed to within a predetermined value from the preset idle speed. The method further includes returning the lower limit value to an original lower limit value in other operating conditions than the idling.

In accordance with another embodiment of the invention, the controller is configured to initially set the lower limit value by adding a fluctuation width of a sensor output inclusive of an output of the throttle position sensor and a fluctuation width of control inclusive of control of the throttle valve to the full closure angle of the throttle valve.

In accordance with another embodiment of the invention, the controller is configured to re-set the lower limit value to a value obtained by subtracting the sensor output fluctuation width from the lower limit value.

In accordance with another embodiment of the invention, the controller is configured to re-set the lower limit value when the rise in the engine rotating speed has continued for a predetermined period of time.

In accordance with another embodiment of the invention, the controller is configured to initially set the lower limit value at other times than the time of idling when the angle of the throttle valve is controlled to the lower limit value.

In accordance with another embodiment of the invention, the controller is configured to initially set the lower limit value of the angle to the angle which is greater than the full closure angle. The full closure angle of the throttle valve includes an angle where the throttle valve is immediately ahead of making contact with a wall surface of an intake passage and where an abutment on a stopper occurs.

In accordance with another embodiment of the invention, the stopper is configured to restrict a turning range of a reduction gear of the motor.

In accordance with another embodiment of the invention, the controller is configured to initially set the lower limit value by adding the fluctuation width of control. The fluctuation width of control is a width corresponding to an overshoot of control inclusive of the control of the throttle valve.

In accordance with another embodiment of the invention, when a target angle for the throttle valve, which is calculated based on the re-set lower limit value, is smaller than the re-set lower limit value, the controller is configured to set the lower limit value as the target angle, thereby controlling the throttle valve.

Embodiments of the invention provide non-obvious advantages over conventional electronic throttle control systems. For example, according to an embodiment of the invention, a lower limit value for an angle (i.e., position) of a throttle valve can be initially set to an angle greater than a full closure angle by a predetermined amount. When a rise in the engine rotating speed by not less than a predetermined value is detected during idling, the lower limit value can be re-set by subtracting a predetermined amount therefrom. Accordingly, the throttle valve can be brought to the full closure position, and loading on a reduction gear present between the throttle valve and the motor can be prevented. In addition, an appropriate quantity of air can be supplied to the engine during idling, even for a vehicle where the diameter of an intake passage is set large (i.e., overbore), and where it may be difficult to appropriately set an idle speed due to dispersions (i.e., scattering) from sensor outputs. Consequently, a rise in the engine rotating speed can be effectively prevented from occurring during idling, thereby enhancing the performance of an engine rotating speed feedback control.

According to an embodiment of the invention, the lower limit value can be preliminarily set as a value obtained by adding a sensor output fluctuation width, which represents dispersions of sensor outputs, and a control fluctuation width, which represents dispersions of control, to the full closure angle of the throttle valve. Therefore, it may be unnecessary to successively update the lower limit value through learning, and it may be possible to simplify a control program in a controller, such as an ECU, and provide a corresponding reduction in cost.

According to an embodiment of the invention, the lower limit value can be re-set as a value obtained by subtracting the sensor output fluctuation width from the lower limit value. Therefore, the throttle valve can be appropriately closed by an amount corresponding to the sensor output fluctuation width at the time of idling, so that a rise in the idle speed can be effectively prevented.

According to an embodiment of the invention, the re-setting of the lower limit value can be carried out when a rise in the engine rotating speed has continued for a predetermined period of time. This makes it possible to re-set the lower limit value in a stable condition.

According to an embodiment of the invention, the lower limit value can be kept at the initially set value at other times besides the time of idling. Consequently, the quantity of air can be prevented from being reduced at other times besides the time of idling.

According to an embodiment of the invention, the full closure angle of the throttle valve can include an angle where the throttle valve precedes making contact with a wall surface of the intake passage and where an abutment on a stopper occurs. This makes it possible to prevent the throttle valve from making contact with a wall surface of the intake passage or being firmly attached to the wall surface.

According to an embodiment of the invention, the stopper may be a stopper that is configured to restrict the turning range of a reduction gear of the motor. Consequently, it is possible to prevent the throttle valve from making contact with the wall surface of the intake passage or being firmly attached to the wall surface.

According to an embodiment of the invention, the fluctuation width of control may include a width corresponding to an overshoot of control. Therefore, it may be possible to set the lower limit value in consideration of dispersions of control. In addition, a margin corresponding to the control fluctuation width may be present between the lower limit value and the full closure angle, even where the sensor output fluctuation width is subtracted at the time of re-setting the lower limit value. Therefore, even for an overshoot relating to the re-set lower limit value due to dispersions of control, the abutment of the reduction gear against the stopper can be effectively obviated.

According to an embodiment of the invention, when a target angle calculated based on the re-set lower limit value is smaller than the re-set lower limit value, the lower limit value is set as the target angle. This makes it possible to appropriately restrict the throttle angle to the lower limit value, and to securely obviate abutment of the reduction gear against the stopper.

DETAILED DESCRIPTION OF EMBODIMENTS

Embodiments of an electronic throttle control system of the invention will be described in detail below with reference to the accompanying drawings.

Figure 1:
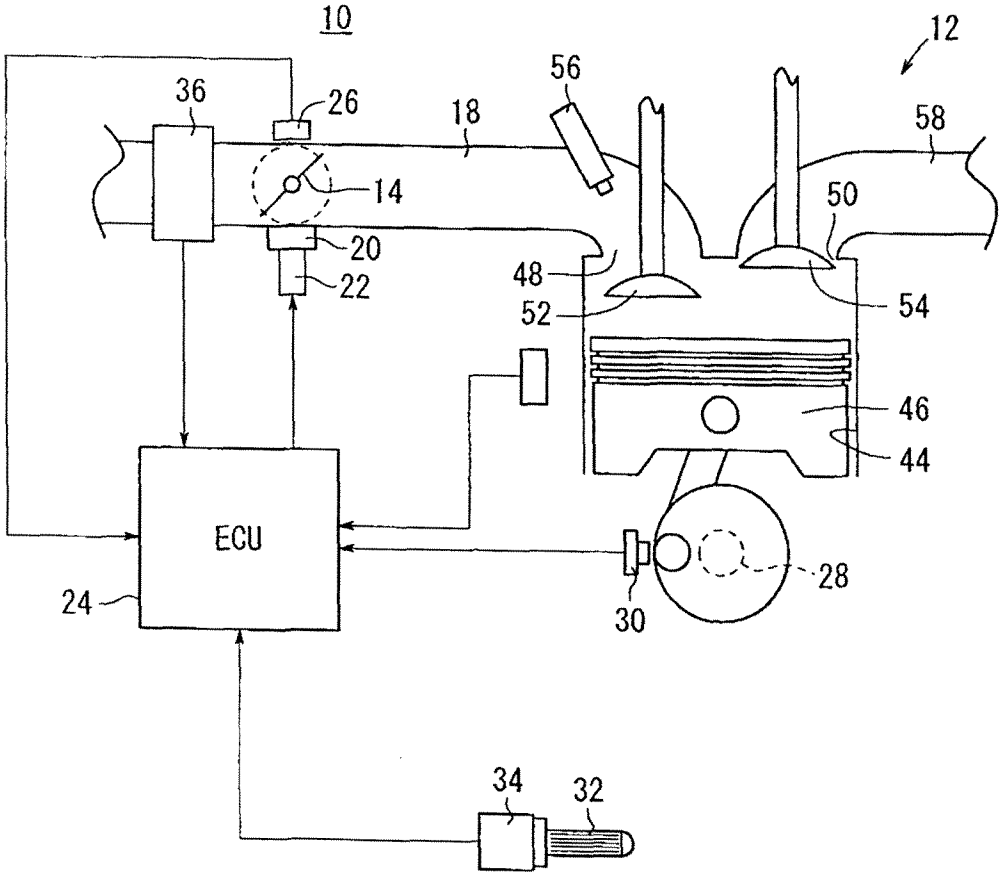
FIG. 1 is a schematic block diagram of an electronic throttle control system, in accordance with an embodiment of the present invention.

FIG. 1 is a schematic block diagram of an electronic throttle control system 10, in accordance with an embodiment of the invention. FIG. 1 shows an application of the electronic throttle control system 10 to an engine 12. The electronic throttle control system (hereinafter, also referred to as "control system 10") can be mounted on a vehicle, for example, a motorcycle or a passenger car. The electronic throttle control system can be used for throttle-by-wire (TBW) control in which the angle (e.g., position) of a throttle valve 14 can be controlled by the driving of a motor 22.

As shown in FIG. 1, the control system 10 can include a throttle valve 14 disposed in an intake passage 18 of the engine 12, a motor 22 for regulating an angle of the throttle valve 14 through a speed reduction mechanism 20, and an electronic control unit or control means ("ECU"), which appropriately drives and controls the motor 22 based on detected values (i.e., detection signals) inputted thereto from various sensors and which performs a total control of the system.

The control system 10 can further include a throttle position sensor 26 for detecting the actual angle of the throttle valve 14, an engine rotating speed sensor 30 for detecting the rotating speed of the engine (e.g., a crankshaft 28), an accelerator angle sensor 34 for detecting the operating amount of an accelerator grip 32, and an airflow meter 36 for detecting the quantity of intake air in an intake passage 18. These sensors can be connected to the ECU 24. The airflow meter 36 may be replaced by a vacuum sensor (not shown) provided on the downstream side of the throttle valve 14.

Figure 2:
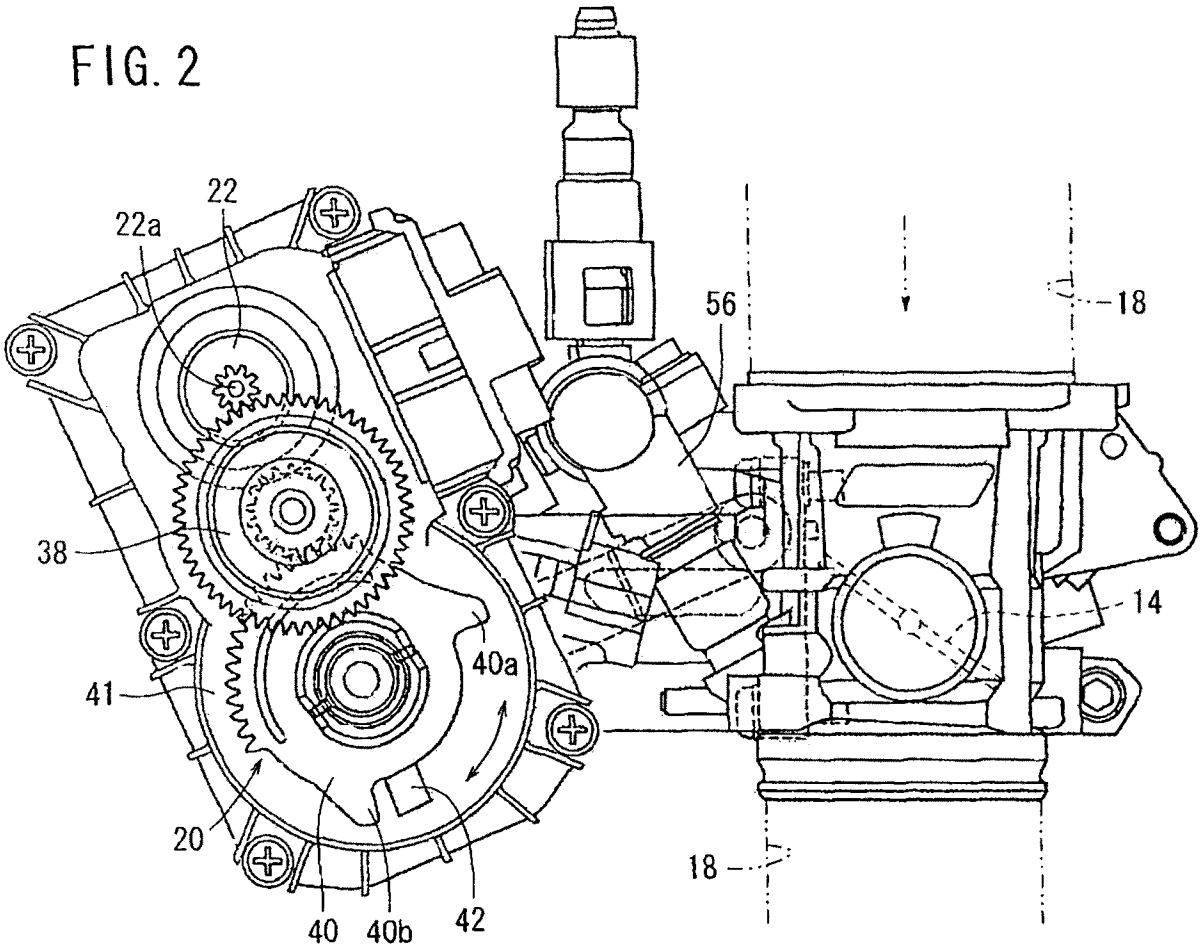
FIG. 2 is a side view showing an example of a motor for driving and controlling a throttle valve, a speed reduction mechanism and the surroundings, in accordance with an embodiment of the invention.

As shown in FIG. 2, the speed reduction mechanism 20 can include a reduction gear 38 driven to rotate by a drive gear 22*a* and secured to a driving shaft of the motor 22, and a link gear (e.g., reduction gear) 40 turned within a predetermined angle by the reduction gear 38. Turning the link gear 40 can cause an opening or closing operation of the throttle valve 14 through a transmission mechanism (not shown). In the link gear 40, a pair of projected parts 40*a* and 40*b* for determining the turning range of the link gear 40, can be provided on a surface of the link gear 40 on the side opposing the contact surface with the reduction gear 38. A housing 41 can be provided between the projected parts 40*a* and 40*b* with a stopper 42 on which the projected parts 40*a* and 40*b* can abut.

The engine 12 can include a four-cylinder, four-cycle internal combustion engine, as shown in FIG. 1, which can include a piston 46 reciprocated inside a cylinder chamber 44 by rotation of the crankshaft 28, and an intake valve 52 and an exhaust valve 54 for opening and closing an intake port 48 and an exhaust port 50, respectively. The intake port 48 can be connected to the intake passage 18, and a fuel injection system 56 and the throttle valve 14 can be disposed on the upstream side thereof. The exhaust port 50 can be connected to an exhaust passage 58. It should be noted that other embodiments of the invention may utilize a different engine configuration.

As shown in FIGS. 1 and 2, in the control system 10 in accordance with an embodiment of the invention, the motor 22 can be driven under the control of the ECU 24 to turn the link gear 40 to open and close the throttle valve 14.

The opening/closing range of the throttle valve 14, for example, the turning range of the link gear 40, can be physically (mechanically) regulated by the abutment of the projected parts 40*a* and 40*b* on the stopper 42. Specifically, a stopper abutment position, where the projected part 40*a* or 40*b* abuts the stopper 42, can correspond to a full closure position or a full opening position of the angle of the throttle valve 14. The full closure angle can include an angle where the throttle valve 14 is immediately ahead of making contact with a wall surface of the intake passage 18. Therefore, with the projected part 40*a* brought into abutment on the stopper 42 earlier, the throttle valve 14 can be prevented from making contact with the wall surface of the intake passage 18.

The reduction gear 38 and/or the link gear 40 constituting the speed reduction mechanism 20 can, in some cases, be made from a resin material for weight reduction or similar purposes. Therefore, in a structure in which the projected part 40*a* (40*b*) abuts the stopper 42 each time of idling where the throttle valve 14 is controlled to the full closure position, the loads on tooth surfaces of the reduction gear 38 and the link gear 40, and the projected parts 40*a* and 40*b* are so high that these components must be provided with sufficient toughness against wear. Naturally, the same holds true even where metallic gears are used.

Thus, in the control system 10 in accordance with an embodiment of the invention, the angle, greater by a predetermined amount than the full closure angle at which the projected part 40*a* (40*b*) abuts the stopper 42, can be initially set as a lower limit value of the position of the throttle valve 14 controlled by driving the motor 22, whereby the abutment of the projected part 40*a* (40*b*) against the stopper 42 can be prevented.

Figure 3:
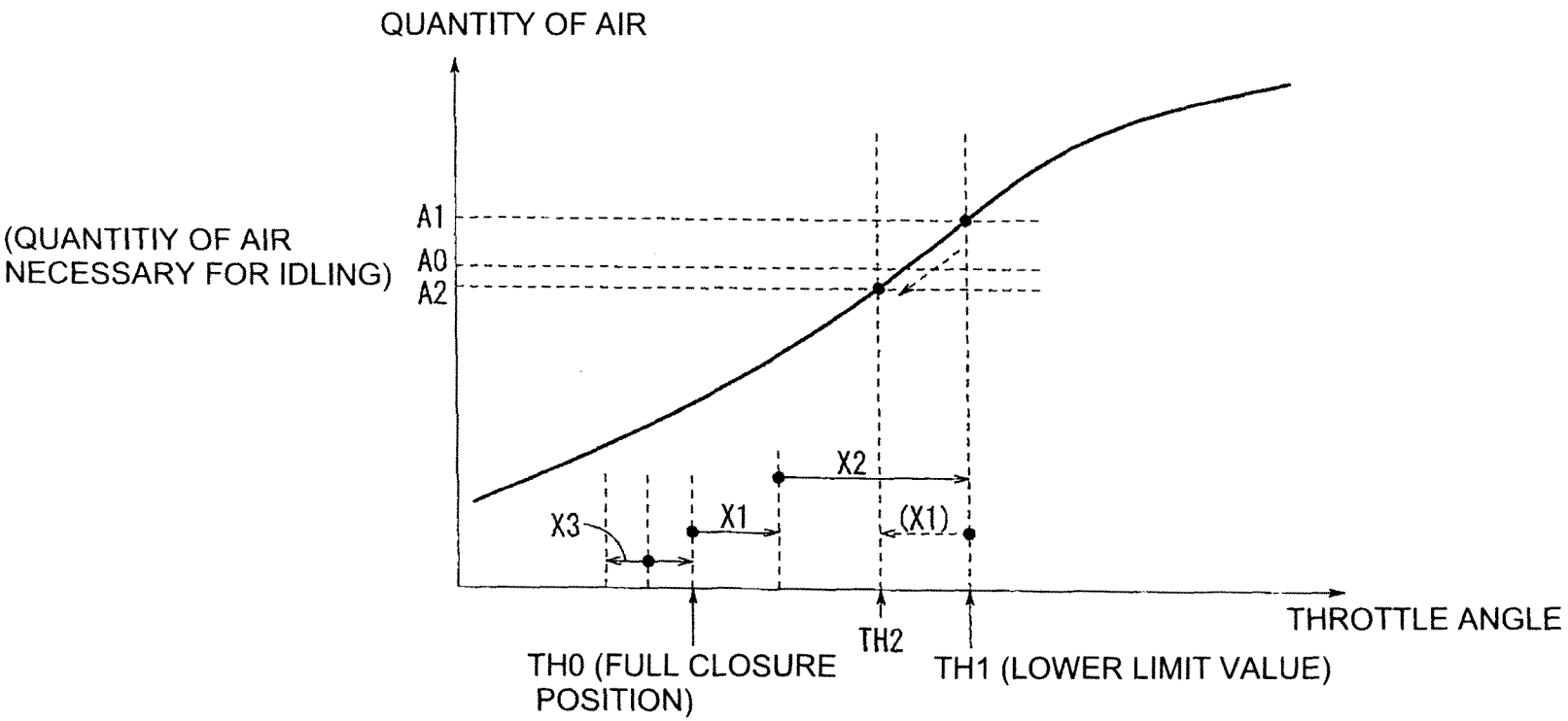
FIG. 3 is a graph showing the relationship between throttle angle and quantity of air supplied, in accordance with an embodiment of the invention.

More specifically, as shown in FIG. 3, with respect to the throttle position, the lower limit value TH1, greater than the full closure angle (i.e., stopper abutment angle) TH0 by a predetermined amount, can be provided. These values can be initially set in a memory (not shown) in the ECU 24. The lower limit value TH1 can be set at a value obtained by adding a sensor output fluctuation width X1, which can represent dispersions of outputs from sensors inclusive of an output from the throttle position sensor 26, and a control fluctuation width X2, which can represent dispersions of controls inclusive of the control of the position (i.e., angle) of the throttle valve 14 to the full closure position TH0. Incidentally, the range represented by X3 in FIG. 3 shows dispersions (i.e., tolerance of tuning) due to tolerances where a plurality of throttle valves are mounted.

The sensor output fluctuation width X1 can indicate, for example, a condition whereby the throttle position sensor 26 is outputting a minute voltage (e.g., about 0.2 V), notwithstanding the actual angle of the throttle valve 14 is 0°, when, for example, the throttle position sensor 26 is set so that its output voltage is 0 V. The control fluctuation width X2 can correspond to an overshoot of control, and can indicate, for example, a condition whereby the throttle angle is momentarily lowered below the lower limit value TH1, when it is attempted to control the throttle angle down to the lower limit value TH1 when the throttle angle is at a certain magnitude.

The control system 10 initially set in this manner can perform a control by which, for example, at the time of idling, the motor 22 can be driven to bring the angle of the throttle valve 14 to the full closure angle, namely, to the lower limit value TH1.

As shown in FIG. 3, however, even if the throttle angle is controlled to the lower limit value TH1 which has been initially set, the quantity of air taken into the engine 12 may become an air quantity A1 in excess of a quantity of air necessary for idling, A0, possibly raising the engine rotating speed at the time of idling. A rise in the engine rotating speed means that the throttle valve may be opened excessively wider than the angle corresponding to the quantity of air necessary for idling, A0. Thus, the throttle angle at the lower limit value TH1 can be needlessly larger by an amount corresponding to the sensor output fluctuation width X1, resulting in a condition where an excess of air, specifically, the quantity A1 of air, can be supplied to the engine 12.

Accordingly, in the electronic throttle control system 10 in accordance with an embodiment of the invention, a control (i.e., lower limit value change-over control) can be performed to re-set the lower limit value TH1, as required, to appropriately reduce the quantity of air at the time of idling to below the quantity of air necessary for idling, A0, and thereby to prevent the above-mentioned rise in the engine rotating speed from occurring.

Figure 4:
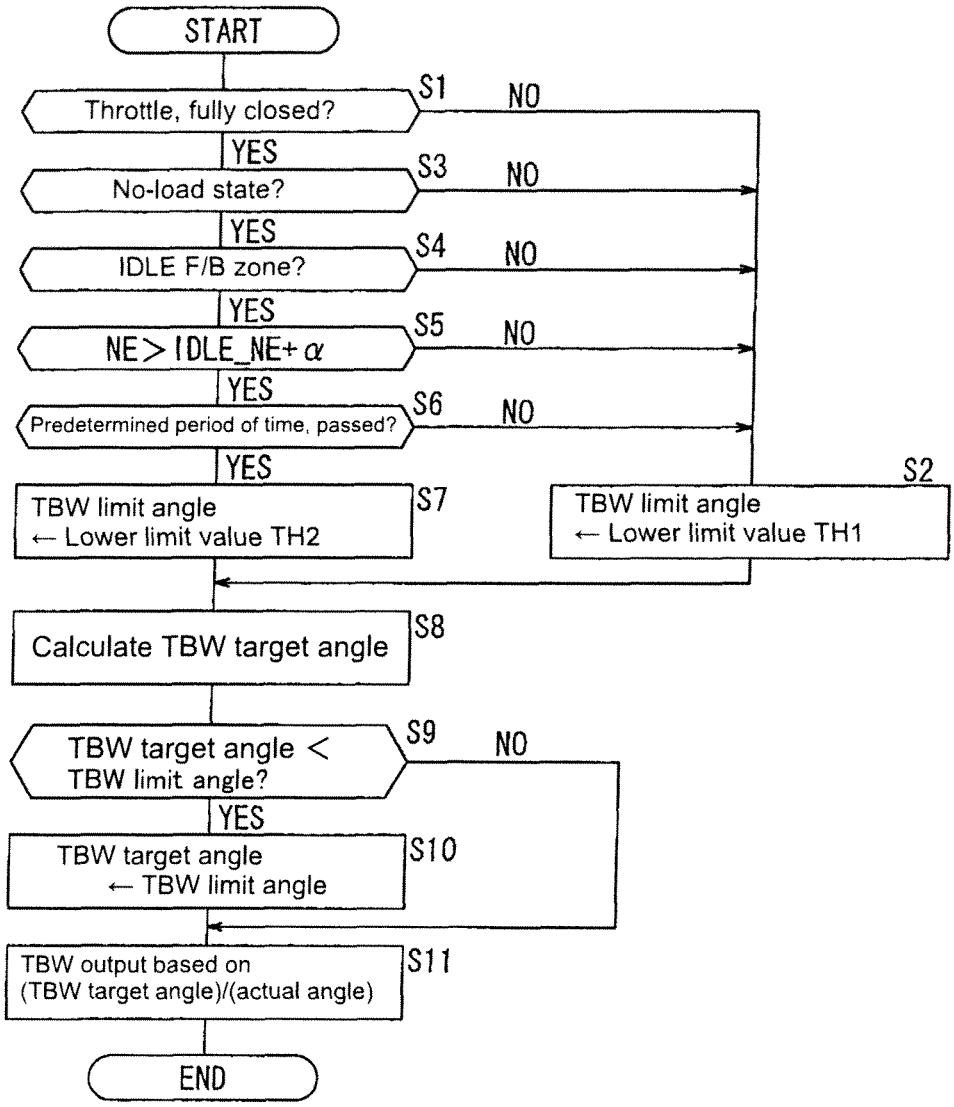
FIG. 4 is a flow chart illustrating an example of a control procedure for change-over of a lower limit value, in accordance with an embodiment of the invention.

FIG. 4 is a flow chart showing an example of the procedure for the lower limit value change-over control, in accordance with an embodiment of the invention. The lower limit value change-over control can be executed as follows, under the control performed by the ECU 24, such as arithmetic processing and decision processes.

First, in step S1 shown in FIG. 4, a determination of whether or not the throttle valve 14 is fully closed is performed based on an output signal from the throttle position sensor 26 (i.e., TH full closure decision). For example, it can be determined whether or not the throttle position sensor 26 is outputting a signal corresponding to a throttle angle of 0°. This throttle position sensor 26 may be outputting this signal due to a condition where the motor 22 is driven under the control of the ECU 24 and the angle of the throttle valve 14 is controlled to the lower limit value TH1, which is the full closure angle based on the control according to the initial setting. When it is decided that the throttle valve 14 is not fully closed (i.e., "NO" upon step S1), step S2 can be executed next. On the other hand, when it is determined that the throttle valve 14 is fully closed (i.e., "YES" upon step S1), step S3 can be subsequently carried out.

In step S3, it can be decided whether or not the vehicle with the electronic throttle control system 10 mounted thereon is in a no-load state (i.e., in the state of being stopped) based on, for example, a vehicle speed sensor. If it is decided that the vehicle is not in a no-load state (i.e., "NO" upon step S3), the control can proceed to step S2. If it is judged that the vehicle is in a no-load state (i.e., "YES" upon step S3), step S4 can be subsequently executed.

In step S4, it can be decided whether or not the control by the ECU 24 is in an idle feedback zone (i.e., IDLE F/B zone) in which a rotating speed feedback control according to an idling state is performed. When it is judged that the control by the ECU 24 is not in the idle feedback control zone (i.e., "NO" upon step S4), the control process can proceed to step S2. On the other hand, when it is decided that the control by the ECU 24 is in the idle feedback zone (i.e., "YES" upon step S4), step S5 can be subsequently executed.

In step S5, it can be decided, based on an output signal from the engine rotating speed sensor 30, whether or not the current engine rotating speed NE is greater than a rotating speed (i.e., IDLE_NE+α) obtained by adding a predetermined value α (i.e., a little fluctuation width) to an idle speed (i.e., preset idle speed) previously set as an engine rotating speed at the time of idling, which is preliminarily set in the ECU 24. When it is decided that the engine rotating speed NE is not greater than the idle speed IDLE_NE+α (i.e., "NO" upon step S5), it can be determined that the engine rotating speed at the time of idling is appropriate, and the control process can proceed to step S2. On the other hand, when the engine rotating speed NE is decided as being greater than the idle speed IDLE_NE+α (i.e., "YES" upon step S5), it can be determined that the engine rotating speed may have increased during idling, and step S6 can be subsequently carried out. Incidentally, while the engine rotating speed NE can be compared with the idle speed IDLE_NE+α in consideration of the predetermined value α as a fluctuation width, in this step S5, the engine rotating speed NE may be compared with the idle speed IDLE_NE (i.e., which is the preset idle speed) without taking the predetermined value α into consideration.

In step S6, it can be decided whether or not a condition where the engine rotating speed NE is above the idle speed IDLE_NE+α and the rotating speed of the engine 12 is accordingly high has continued for a predetermined period of time. When the predetermined period of time has not elapsed since the condition of the engine rotating speed NE being above the idle speed IDLE_NE+α started (i.e., "NO" upon step S6), step S2 can be executed next. On the other hand, when the predetermined period of time has elapsed since the condition of the engine rotating speed NE being above the idle speed IDEL_NE+α started and it is determined that the rotating speed of the engine 12 is high, notwithstanding the current time is the time of idling (i.e., "YES" upon step S6), it can be determined that the excess quantity A1 of air is being supplied to the engine 12 (see FIG. 3), and step S7 can be subsequently executed.

When the results of the decisions in all of the steps S1 and S3 to S6 are "YES," and it is accordingly determined that the rotating speed of the engine 12 is high, notwithstanding the current time is the time of idling, a quantity A1 of air in excess of the quantity of air necessary for idling, A0, can be supplied to the engine 12 at the lower limit value TH1 adopted as the throttle full closure angle. In other words, at the current lower limit value TH1, the throttle angle cannot be lowered to a value corresponding to the quantity of air necessary for idling, A0.

Thus, in step S7, as shown in FIG. 3, the lower limit value, (i.e., idle blow-up limit value) being a throttle angle obtained by subtracting the sensor output fluctuation width X1 from the lower limit value TH1, can be re-set as a TBW limit angle, for example, a control limit value in the TBW control. In this manner, a control of lowering the quantity A1 of air in excess of the quantity of air necessary for idling, A0, to a quantity A2 of air below the quantity of air necessary for idling, A0, can be performed so that the engine rotating speed NE will be within the predetermined value a from the idle speed IDLE_NE used as the preset idle speed (i.e., within plus or minus several percent from the idle speed).

On the other hand, in the case where a result of a decision in any of steps S1 and S3 to S6 is "NO," and it is determined that the engine rotating speed at the time of idling is appropriately controlled, air in an appropriate quantity equal to or below the quantity of air necessary for idling, A0, can be supplied to the engine 12 owing to the lower limit value TH1 adopted as the throttle full closure control angle. Thus, in step S2, the current lower limit value TH1 can be re-set as the TBW limit angle (i.e., the setting is maintained).

Next, in step S8, based on the TBW limit angle set in step S2 or step S7 (i.e., in step S2, the lower limit value TH1; in step S7, the lower limit TH2), the ECU 24 can calculate a TBW target angle to be used as a target throttle angle in the TBW control by referring to the vehicle conditions, such as the engine rotating speed NE.

In step S9, it is determined whether or not the TBW target angle calculated in step S8 is smaller than the TBW limit angle set in step S2 or step S7. When the TBW target angle is smaller than the TBW limit angle (i.e., "YES" upon step S9), step S10 can be subsequently executed, in which the TBW limit angle is re-set as the TBW target angle, and then step S11 can be carried out. Specifically, in step S10, the throttle angle can be restricted to the TBW limit angle to obviate a situation in which the projected part 40*a* (40*b*) abuts the stopper 42 due to excessive turning of the throttle valve 14 in a valve closing direction. Incidentally, when it is decided in step S9 that the TBW target angle is not less than the TBW limit angle ("NO" upon S9), step S11 can be next performed.

In step S11, the proportion of the TBW target angle to the actual angle of the throttle valve 14 detected by the throttle position sensor 26, for example, TBW target angle/actual angle, can be calculated, and outputting of the TBW control can be performed based on the calculation result. Therefore, the motor 22 can be driven under the control of the ECU 24, and the throttle valve 14 can be driven and brought to an angle position of the TBW target angle by the driving of the motor 22, whereby an appropriate idling state of the engine 12 can be maintained.

Incidentally, when an accelerator operation is performed, starting from the condition where an appropriate idling rotation is maintained and the vehicle is thereby put into an operating state (i.e., normal running state) other than the idling state, a control can be executed by which the re-set lower limit value TH2 can be returned to the original lower limit value TH1.

Thus, in the electronic throttle control system 10 in accordance with an embodiment of the invention, the following control can be performed. When a rise in the engine rotating speed NE by at least a predetermined value $\alpha$ from an idle speed IDLE_NE provided as a preset idle speed is detected, during idling where the angle of the throttle valve is controlled to a full closure angle, or an initially set lower limit value TH1, the lower limit value TH1 can be re-set to a lower limit value TH2 reduced by a predetermined amount. The engine rotating speed NE can be controlled to within a predetermined value from the idle speed IDLE_NE used as the preset idle speed (i.e., within plus or minus several percent from the idle speed). Specifically, when a predetermined condition (i.e., passage of a predetermined period of time from the start of a state of the engine rotating speed being high during idling) is satisfied, a control can be performed in which the lower limit value is changed over to the lower limit value TH2 obtained by subtracting a sensor output fluctuation width X1 from the original lower limit value. The quantity of air that can be supplied to the engine 12 can be brought to equal to or below the quantity of air necessary for idling, A0.

As a result, loading on the reduction gear 38 and/or the link gear 40 constituting the speed reduction mechanism 20 can be effectively prevented. Further, supply of an appropriate quantity of air to the engine 12 during idling can be achieved, even when, for example, the vehicle is based on a system in which the diameter of the intake passage is set large (i.e., overbore), and where it may be difficult to appropriately set an idle speed due to sensor dispersions. Therefore, it can be easy to perform an engine rotating speed feedback control, and it can be possible to effectively prevent the engine rotating speed from being raised during idling. In addition, when the vehicle is brought into an operating state (i.e., normal running state) other than the idling state after the lower limit value is re-set from TH1 to TH2, a control of returning the re-set lower limit value TH2 to the original lower limit value TH1 can be performed. This ensures that, at the time of normal running, a throttle control, based on the lower limit value TH1 provided as an initial set point preliminarily set in consideration of sensor dispersions and control dispersions, can be carried out. An appropriate control of the engine rotating speed according to the operating condition can be achieved.

Moreover, the lower limit change-over control can be conducted when the condition of a high engine rotating speed during idling has continued for a predetermined period of time. The re-setting of the lower limit value can always be performed in a stable condition.

In this case, the re-set lower limit value TH2 can be set by subtracting the sensor output fluctuation width X1, representing sensor dispersions, from the initially set lower limit value TH1. Therefore, the throttle can be appropriately closed by an amount corresponding to the sensor output fluctuation width X1 at the time of idling, whereby a rise in the idle speed can be effectively prevented. The lower limit value TH1 can be preliminarily set by an initial setting in consideration of the control fluctuation width X2, which represents dispersions of control, together with the sensor output fluctuation width X1. This makes it possible to effectively obviate the abutment of the projected part 40*a* (40*b*) of the link gear 40 against the stopper 42, even when the sensor output fluctuation width X1 is subtracted at the time of re-setting the lower limit value.

Moreover, even where the sensor output fluctuation width X1 is subtracted at the time of re-setting the lower limit value, a margin corresponding to the control fluctuation width X2 can be provided ahead of the abutment of the projected part 40*a* (40*b*) on the stopper 42. Therefore, even where an overshoot of the re-set lower limit value TH2 is generated due to dispersions of control, the abutment of the projected part 40*a* (40*b*) on the stopper 42 can be avoided.

The lower limit value TH1 can be preliminarily set as a value obtained by adding the sensor output fluctuation width X1 and the control fluctuation width X2 to the full closure angle TH0. Therefore, it may be unnecessary to successively update the lower limit value TH1 through learning, and it may be possible to achieve simplification of the control program in the ECU 24 and a corresponding reduction in cost.

The re-setting of the lower limit value may not be conducted, but the initially set lower limit value TH1 can be used at other times than the time of idling, when the angle of the throttle valve 14 is controlled to the full closure angle, for example, to the lower limit value TH1. As a result, the quantity of air supplied to the engine 12 can be prevented from being reduced at other times than the time of idling, and the processing load on the ECU 24 can be reduced.

It should be noted that the invention is not limited to the above-described embodiments, and various configurations or steps may naturally be adopted within the scope of the invention.

For example, the speed reduction mechanism 20 for transmitting to the throttle valve 14 the rotation of the motor 22 being driven under the control of the ECU 24 may be of other configurations than the configuration in which the reduction gear 38 and the link gear 40 are used.

In addition, while the ECU 24 has been described as a controller or control means having the functions of a lower limit value re-setting section for re-setting the lower limit value, a TH angle control section for controlling the throttle angle and a TBW angle calculating section for calculating a throttle angle in the TBW control, in the above embodiments, these sections or functions may be provided in other controllers or control means separate from the ECU 24.

DESCRIPTION OF REFERENCE NUMERALS

10 . . . Electronic throttle control system
12 . . . Engine
14 . . . Throttle valve
20 . . . Speed reduction mechanism
22 . . . Motor
24 . . . ECU
26 . . . Throttle sensor
30 . . . Engine rotating speed sensor
42 . . . Stopper

We claim:

1. An electronic throttle control system, comprising:
a throttle valve;
a motor configured to drive the throttle valve;
a throttle position sensor configured to detect an angle of the throttle valve;
an engine rotating speed detector; and
a controller configured to
drive the motor to control the angle of the throttle valve by initially setting a lower limit value of the angle to an angle which is greater than a full closure angle of the throttle valve by a predetermined amount, and
when a rise in an engine rotating speed by not less than a predetermined value from a preset idle speed is detected, using the engine rotating speed detector, during idling in which the angle of the throttle valve is controlled to the lower limit value, re-set the lower limit value to reduce the lower limit value by a predetermined amount to control the engine rotating speed to within a predetermined value from the preset idle speed, and to return the lower limit value to an original lower limit value in other operating conditions than the idling.

2. The electronic throttle control system according to claim 1, wherein the controller is configured to initially set the lower limit value by adding a fluctuation width of a sensor output inclusive of an output of the throttle position sensor, and a fluctuation width of control inclusive of control of the throttle valve to the full closure angle of the throttle valve.

3. The electronic throttle control system according to claim 2, wherein the controller is configured to re-set the lower limit value to a value obtained by subtracting the sensor output fluctuation width from the lower limit value.

4. The electronic throttle control system according to claim 1, wherein the controller is configured to re-set the lower limit value when the rise in the engine rotating speed has continued for a predetermined period of time.

5. The electronic throttle control system according to claim 1, wherein the controller is configured to initially set the lower limit value at other times than the time of idling when the angle of the throttle valve is controlled to the lower limit value.

6. The electronic throttle control system according to claim 1, wherein the controller is configured to initially set the lower limit value of the angle to the angle which is greater than the full closure angle, wherein the full closure angle comprises an angle where the throttle valve is immediately ahead of making contact with a wall surface of an intake passage and where an abutment on a stopper occurs.

7. The electronic throttle control system according to claim 6, wherein the stopper is configured to restrict a turning range of a reduction gear of the motor.

8. The electronic throttle control system according to claim 2, wherein the controller is configured to initially set the lower limit value by adding the fluctuation width of control, wherein the fluctuation width of control is a width corresponding to an overshoot of control inclusive of the control of the throttle valve.

9. The electronic throttle control system according to claim 1, when a target angle for the throttle valve, which is calculated based on the re-set lower limit value, is smaller than the re-set lower limit value, the controller is configured to set the lower limit value as the target angle to control the throttle valve.

10. An electronic throttle control system, comprising:

throttle means for controlling air intake;

driving means for driving the throttle means;

throttle position sensing means for detecting an angle of the throttle means;

engine rotating speed detecting means for detecting rotating speed of an engine; and controlling means for driving the driving means to control the angle of the throttle means by initially setting a lower limit value of the angle to an angle which is greater than a full closure angle of the throttle means by a predetermined amount, and when a rise in the engine rotating speed by not less than a predetermined value from a preset idle speed is detected, using the engine rotating speed detecting means, during idling in which the angle of the throttle means is controlled to the lower limit value, re-setting the lower limit value to reduce the lower limit value by a predetermined amount to control the engine rotating speed to within a predetermined value from the preset idle speed, and to return the lower limit value to an original lower limit value in other operating conditions than the idling.

11. A method for controlling a throttle valve in an electronic throttle control system, the method comprising:

driving, using a controller, a motor to control an angle of the throttle valve by initially setting a lower limit value of the angle to an angle which is greater than a full closure angle of the throttle valve by a predetermined amount, and when a rise in an engine rotating speed by not less than a predetermined value from a preset idle speed is detected, during idling in which the angle of the throttle valve, is controlled to the lower limit value, re-setting, using the controller, the lower limit value to reduce the lower limit value by a predetermined amount to control the engine rotating speed to within a predetermined value from the preset idle speed, and to return the lower limit value to an original lower limit value in other operating conditions than the idling.

12. The method according to claim 11, wherein the driving comprises initially setting the lower limit value by adding a fluctuation width of a sensor output inclusive of an output of the throttle position sensor, and a fluctuation width of control inclusive of control of the throttle valve to the full closure angle of the throttle valve.

13. The method according to claim 12, wherein the re-setting comprises re-setting the lower limit value to a value obtained by subtracting the sensor output fluctuation width from the lower limit value.

14. The method according to claim 11, wherein the re-setting the lower limit value occurs when the rise in the engine rotating speed has continued for a predetermined period of time.

15. The method according to claim 11, wherein the driving comprises initially setting the lower limit value at other times than the time of idling, when the angle of the throttle valve is controlled to the lower limit value.

16. The method of claim 11, wherein the driving comprises initially setting the lower limit value of the angle to the angle which is greater than the full closure angle, wherein the full closure angle comprises an angle where the throttle valve is immediately ahead of making contact with a wall surface of an intake passage and where an abutment on a stopper occurs.

17. The method according to claim 12, wherein the driving comprises initially setting the lower limit value by adding the fluctuation width, wherein the fluctuation width of control is a width corresponding to an overshoot of control inclusive of the control of the throttle valve.

18. The method according to claim 11, further comprising:

when a target angle for the throttle valve, which is calculated based on the re-set lower limit value, is smaller than the re-set lower limit value, setting the lower limit value as the target angle to control the throttle valve.

* * * * *